US009799466B2

(12) United States Patent
Wu

(10) Patent No.: US 9,799,466 B2
(45) Date of Patent: Oct. 24, 2017

(54) KEYBOARD SWITCH

(71) Applicant: Fuxi Wu, Dongguan (CN)

(72) Inventor: Fuxi Wu, Dongguan (CN)

( * ) Notice: Subject to any disclaimer, the term of this patent is extended or adjusted under 35 U.S.C. 154(b) by 0 days.

(21) Appl. No.: 15/247,972

(22) Filed: Aug. 26, 2016

(65) Prior Publication Data

US 2017/0062152 A1 Mar. 2, 2017

(30) Foreign Application Priority Data

Aug. 27, 2015 (CN) ..... 2015 2 0652289 U

(51) Int. Cl.

| | |
|---|---|
| ***H01H 13/14*** | (2006.01) |
| ***H01H 3/12*** | (2006.01) |
| ***H01H 13/28*** | (2006.01) |
| ***H01H 13/52*** | (2006.01) |
| ***H01H 13/85*** | (2006.01) |

(52) U.S. Cl.

CPC ..... *H01H 13/14* (2013.01); *H01H 3/125* (2013.01); *H01H 13/285* (2013.01); *H01H 13/52* (2013.01); *H01H 13/85* (2013.01); *H01H 2013/525* (2013.01); *H01H 2221/058* (2013.01); *H01H 2225/028* (2013.01)

(58) Field of Classification Search

CPC ..... H01H 3/125; H01H 13/83; H01H 13/705; H01H 2215/006

USPC ..... 200/5 A, 341–345, 314, 512

See application file for complete search history.

(56) References Cited

U.S. PATENT DOCUMENTS

| | | | | |
|---|---|---|---|---|
| 2010/0243419 | A1* | 9/2010 | Lee | H01H 3/125 200/344 |
| 2012/0048700 | A1* | 3/2012 | Liu | H01H 13/705 200/5 A |
| 2013/0134022 | A1* | 5/2013 | Liang | H01H 13/705 200/5 A |

* cited by examiner

*Primary Examiner* — Edwin A. Leon
*Assistant Examiner* — Ahmed Saeed
(74) *Attorney, Agent, or Firm* — Matthias Scholl, PC; Matthias Scholl

(57) ABSTRACT

A keyboard switch, including a base; a static contact; a moving contact; an upper cover; a button; a reset spring; an X-shaped rack structure; and a holding part. The X-shaped rack structure includes a first connecting rack and a second connecting rack. The first connecting rack includes a first balancing lever and two first connecting parts sleeving on the first balancing lever, the second connecting rack includes a second balancing lever and two second connecting parts sleeving on the second balancing lever; opposite surfaces of the two first connecting parts each are provided with one boss, facing surfaces of the two second connecting parts each are provided with one round hole, and the boss is inserted in the round hole so that two ends of the two first connecting racks and two ends of the two second connecting racks are connected to form two X-shaped structures.

7 Claims, 4 Drawing Sheets

KEYBOARD SWITCH

CROSS-REFERENCE TO RELATED APPLICATIONS

Pursuant to 35 U.S.C. §119 and the Paris Convention Treaty, this application claims the benefit of Chinese Patent Application No. 201520652289.5 filed Aug. 27, 2015, the contents of which are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention is related to a keyboard switch, and more particularly to a keyboard switch.

Description of the Related Art

Conventionally, an individual keyboard switch includes a base and a button including a positioning column. The positioning column is capable of moving upward and downward in the opening of the base to activate the circuit. However, the contact area of the positioning column and the base is usually small, and the button tends to tilt or get stuck when being pressed. The pressing part of the button is a guide pillar, which increases the thickness of the keyboard switch, and the use thereof is inconvenient. In addition, the buttons are not easy to distinguish by touch, leading to unsatisfactory user experience.

SUMMARY OF THE INVENTION

In view of the above-described problems, it is one objective of the invention to provide a keyboard switch with X-shaped rack structure that has good sense of touch, convenient operation and use, and can prevent the slanting and jamming of the button of the keyboard switch upon being pressed.

In view of the above-described problems, it is one objective of the invention to provide a keyboard switch, comprising a base; a static contact; a moving contact; an upper cover; a button, configured to control the contact of the static contact and the moving contact; a reset spring, configured to control the reset of the button; an X-shaped rack structure; and a holding part, being disposed on the base to hold the X-shaped rack structure.

The upper cover is buckled on the base, and both the static contact and the moving contact are disposed on the base; one end of the button is installed on the base and is capable of moving upwards and downwards, another end thereof passes through the upper cover, and both ends of the reset spring abut against the button and the base, respectively. The X-shaped rack structure comprises a first connecting rack and a second connecting rack which are rotatably embedded in the holding part. The first connecting rack comprises a first balancing lever and two first connecting parts sleeving on the first balancing lever, the second connecting rack comprises a second balancing lever and two second connecting parts sleeving on the second balancing lever; opposite surfaces of the two first connecting parts each are provided with one boss, facing surfaces of the two second connecting parts each are provided with one round hole, and the boss is inserted in the round hole so that two ends of the two first connecting racks and two ends of the two second connecting racks are connected to form two X-shaped structures; and the holding part comprises a first rotating slot at two opposite sides of the base and a second rotating slot at another two opposite sides of the base.

In a class of this embodiment, the first balancing lever comprises a first lever body and two first extension arms. The two first extension arms are integratedly extended from two ends of the first lever body, respectively; two ends of two first extension arms are bent to form two first connecting arms, the two first connecting arms are mutually reverse, and the two first connecting parts are respectively sleeved on the two first connecting arms. The second balancing lever comprises a second lever body and two second extension arms, the two second extension arms are integratedly extended from two ends of the second lever body, respectively; two ends of two second extension arms are bent to form the second connecting arm, the two second connecting arms are mutually reverse, and two second connecting parts are respectively disposed on the two second connecting arms; a bending part is disposed in a middle of the second lever body. The first lever body is embedded in the first rotating slot rotatably, and the two first connecting arms are embedded in the second rotating slot rotatably. The second lever body is embedded in the first rotating slot rotatably, and the two second connecting arms are embedded in the second rotating slot.

In a class of this embodiment, the first connecting part is located in the button, and the second connecting part is located out of the button.

In a class of this embodiment, the first connecting part is located in the button, and the second connecting part is located in the button.

In a class of this embodiment, the first connecting part is located out of the button, and the second connecting part is located out of the button.

In a class of this embodiment, the first connecting part is located out of the button, and the second connecting part is located in the button.

In a class of this embodiment, the upper cover and the base are buckled to form a first containing chamber and a second containing chamber. The static contact and the moving contact are located in the first containing chamber, the button and the reset spring are located in the second containing chamber. The first balancing lever and the second balancing lever are located in the second containing chamber.

The beneficial effect of the keyboard switch of the invention is as follows:

1. The X-shaped rack structure capable of preventing the slanting of the button is disposed, the first connecting rack and the second connecting rack of the X-shaped rack structure are used for button positioning, and both ends of the first connecting rack and both ends of the second connecting rack form two X-shaped structures; therefore, when pressing down four corners of the button, two X-shaped structures can make the central axis of the button always vertical to the base central axis and ensure that the button is not slanted and does not get stuck upon being pressed, thus ensuring that the switch has good sense of touch, convenient operation and use, and can prevent the slanting and jamming of the button of the keyboard switch upon being pressed.

2. The first connecting rack and the second connecting rack are symmetrically disposed at both sides of the button. When the user presses down the button from a tilt angle, the rotation of the first balancing lever of the first connecting rack and the second balancing lever of the second connecting rack can offset pressing force distribution in the slanting direction, thus further preventing the slanting and jamming of the button.

3. The first balancing lever of the first connecting rack and the second balancing lever of the second connecting rack can be rotated and installed at both sides of the button back and forth through two connecting arms and can be rotated and installed on the base through two lever bodies. The friction force between the first connecting rack, the second connecting rack, button and the base is small and can avoid the slanting of the button, and save labor for switch pressing.

DETAILED DESCRIPTION OF THE EMBODIMENTS

The invention is described hereinbelow with reference to the accompanying drawings.

Figure 1:
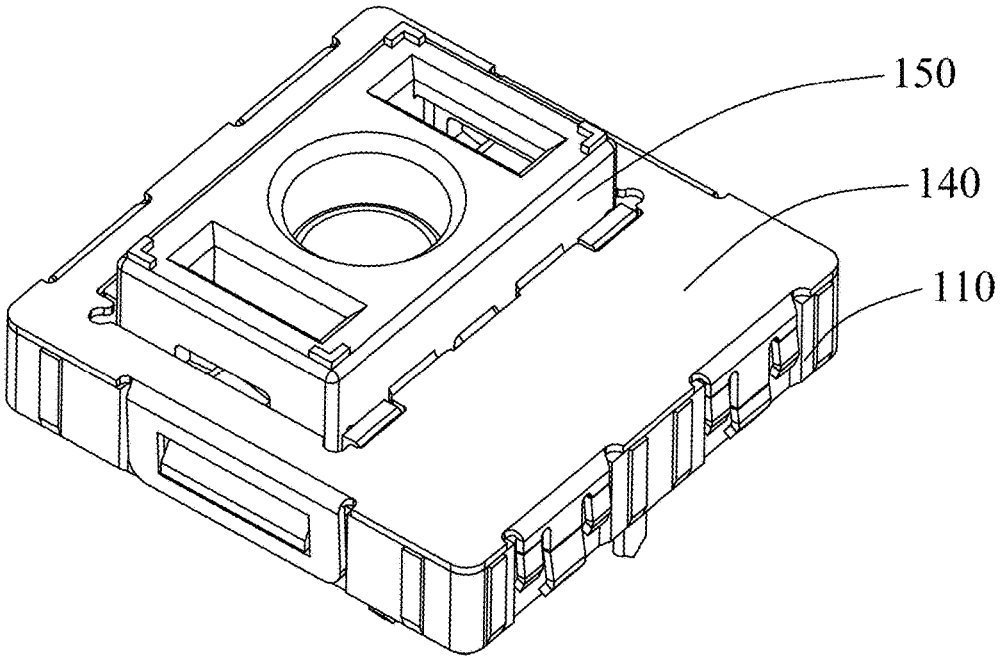
FIG. 1 is a stereogram of a keyboard switch according to one embodiment of the invention.
Figure 2:
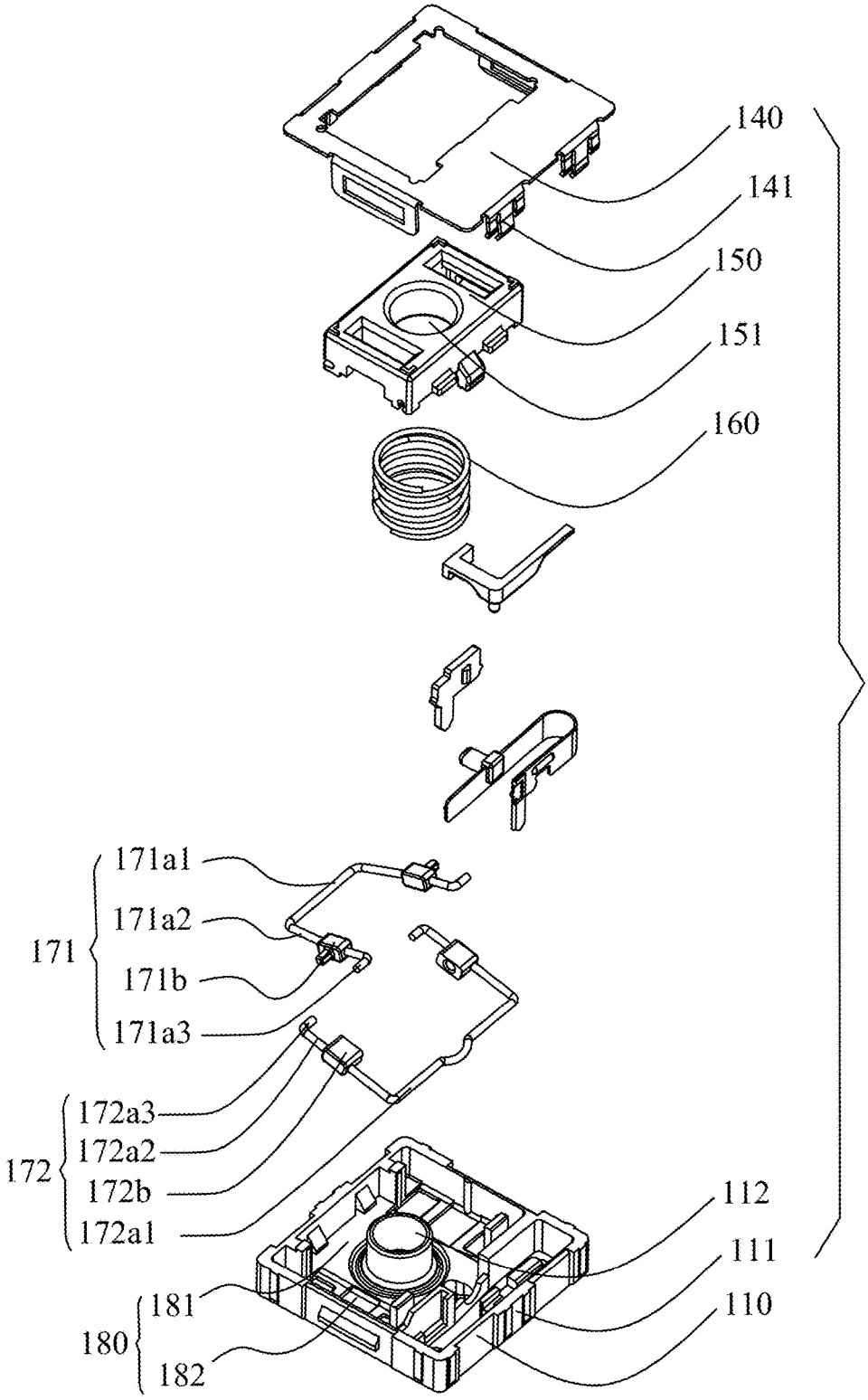
FIG. 2 is an explosive view of a stereogram of a keyboard switch according to one embodiment of the invention.
Figure 3:
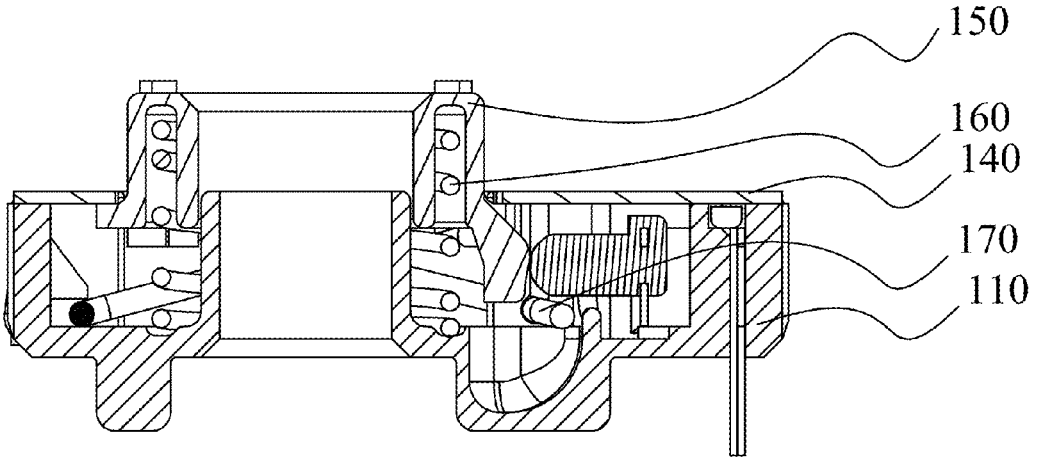
FIG. 3 is a sectional view of a stereogram of a keyboard switch according to one embodiment of the invention.
Figure 4:
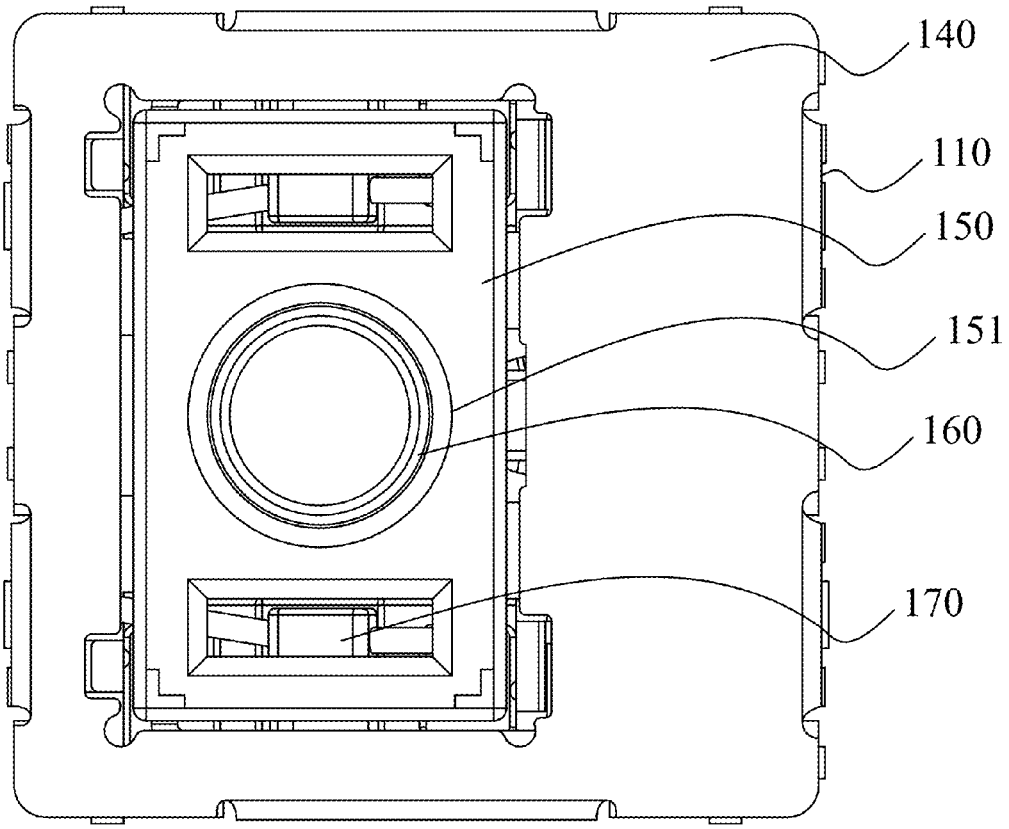
FIG. 4 is a bottom view of a stereogram of a keyboard switch according to one embodiment of the invention.
Figure 5:
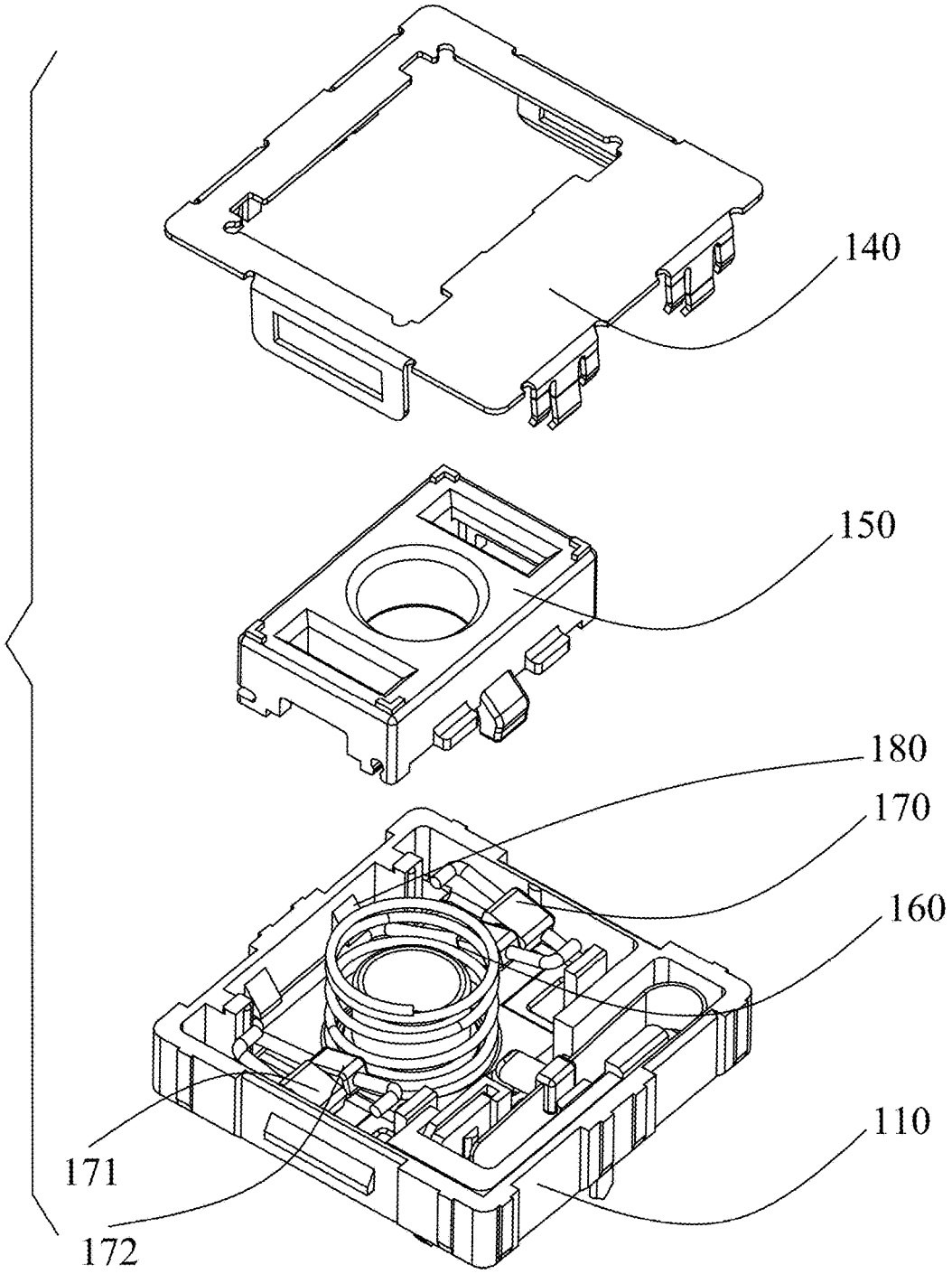
FIG. 5 is an exploded view of a stereogram of a keyboard switch according to one embodiment of the invention.

FIGS. 1-5 respectively show a stereogram, explosive view, sectional view, bottom view and exploded view of a keyboard switch of the invention. The keyboard switch 100 has X-shaped rack structure 170, and comprises a base 110, a static contact, a moving contact, an upper cover 140, a button 150, and a reset spring 160. The button 150 operates to control the contact of the static contact and the moving contact, and the reset spring 160 operates to control the reset of the button 150.

The upper cover 140 is buckled on the base 110, and both the static contact and the moving contact are disposed on the base 110. One end of the button 150 is installed on the base 110 and is capable of moving upwards and downwards, another end thereof passes through the upper cover 140, and both ends of the reset spring 160 abut against the button 150 and the base 110, respectively. The keyboard switch further comprises one X-shaped rack structure 170 configured to prevent the slanting of the button 150 and one holding part 180 holding X-shaped rack structure on the base. The holding part 180 comprises a first rotating slot 181 at two opposite sides of the base and a second rotating slot 182 at another two opposite sides of the base.

The X-shaped rack structure 170 comprises a first connecting rack 171 and a second connecting rack 172; the first connecting rack 171 comprises a first balancing lever and two first connecting parts 171*b* on the first balancing lever, the second connecting rack 172 comprises the second balancing lever 172*a* and two second connecting parts 172*b* on the second balancing lever 172*a*. The backs of two first connecting parts 171*b* are provided with one boss, the opposite surfaces of two second connecting parts 172*b* are provided with one round hole, and the boss can be inserted in the round hole to enable both ends of the first connecting rack 171 and both ends of the second connecting rack 172 to form two X-shaped structures.

The first balancing lever comprises a first lever body 171*a*1 and two first extension arms 171*a*2. Two first extension arms 171*a*2 are respectively extended integratedly from two ends of the first lever body 171*a*1, the end of two first extension arms 171*a*2 is bent and the first connecting arm 171*a*3 is extended, two first connecting arms 171*a*3 are mutually reverse, and two first connecting parts 171*b* are respectively disposed on two first connecting arms 171*a*3; the second balancing lever 172*a* comprises the second lever body 172*a*1 and two second extension arms 172*a*2, two second extension arms 172*a*2 are respectively extended integratedly from two ends of the second lever body 172*a*1, the end of two second extension arms 172*a*2 is bent and the second connecting arm 172*a*3 is extended, two second connecting arms 172*a*3 are mutually reverse, and two second connecting parts 172*b* are respectively disposed on two second connecting arms 172*a*3. One bending part is disposed in the middle of the second lever body 172*a*1. The first connecting rack 171 and the second connecting rack 172 are symmetrically disposed between the button 150 and the base 110. The first lever body 171*a*1 can be embedded in the first rotating slot 181 rotatably, and two first connecting arms 171*a*3 can be respectively embedded in the corresponding second rotating slot 182 rotatably; the second lever body 172*a*1 can be embedded in the first rotating slot 181 rotatably, and two second connecting arms 172*a*3 can be respectively embedded in the corresponding second rotating slot 182.

In the example, the first connecting part 171*b* is located in the button 150, and the second connecting part 172*b* is located out of the button 150; in another example, the first connecting part 171*b* is located in the button 150, and the second connecting part 172*b* is located out of the button 150; or the first connecting part 171*b* is located out of the button 150, the second connecting part 172*b* is located out of the button 150; or the first connecting part 171*b* is located out of the button 150, and the second connecting part 172*b* is located in the button 150.

Two opposite sides of the upper cover 140 are provided with two sprockets 141 at regular intervals, and two opposite sides of the base 110 correspond to the outward bulge between two sprockets 141 to form one bulge 111. The sprocket 141 can be buckled at both sides of the bulge 111, and the upper cover 140 and the base 110 are mutually buckled through the sprocket 141 and the bulge 111.

The upper cover 140 and the base 110 are buckled to form the first containing chamber and the second containing chamber; the static contact and the moving contact are located in the first containing chamber, the button 150 and the reset spring 160 are located in the second containing chamber; the first balancing lever 171*a* and the second balancing lever 172*a* are located in the second containing chamber.

The button 150 is provided with the guide hole 151; correspondingly, the base 110 is provided with the guide column 112, and the guide hole 151 is located out of the guide column 112 and moves upwards and downwards along the guide column 112.

The static contact is provided with the static contact point 121 and the first welding pin 122, the moving contact is provided with the moving contact point 131 and the second welding pin 132, the static contact point 121 and the moving contact point 131 are equipped correspondingly, and the first welding pin 122 and the second welding pin 132 are extended out of the base 110.

The X-shaped rack structure 170 which can prevent the slanting of the button 150 is provided, the first connecting rack 171 and the second connecting rack 172 of the X-shaped rack structure 170 are used to position the button 150, and both ends of the first connecting rack 171 and both ends of the second connecting rack 172 form two X-shaped structures; therefore, when pressing down four corners of the button 150, two X-shaped structures can make the button 150 central axis always vertical to the base 110 central axis and ensure that the button 150 will not easily be slanted and seized during pressing, thus ensuring that the switch can have labor-saving operation, smooth handfeel and good sense of touch during pressing.

The first connecting rack 171 and the second connecting rack 172 are symmetrically disposed at both sides of the button 150. When the user presses down the button 150 in a tilt angle, rotation of the first balancing lever 171*a* of the first connecting rack 171 and the second balancing lever 172*a* of the second connecting rack 172 can offset pressing force distribution in the slanting direction, thus further preventing the slanting of the button 150 and jamming and ensuring the convenient use.

The first balancing lever 171*a* of the first connecting rack 171 and the second balancing lever 172*a* of the second connecting rack 172 can be rotated and installed at both sides of the button 150 back and forth through two connecting arms and can be rotated and installed on the base 110 through two lever bodies. The small friction force between the first connecting rack 171, the second connecting rack 172, the button 150 and the base 110 can avoid the slanting of the button 150, make more labor-saving switch pressing, and further ensure the convenient use.

The upper cover 140 is provided with a sprocket 141 at regular intervals, the base 110 protrudes to form one bulge 111, the sprocket 141 can be buckled at both sides of the bulge 111, and the upper cover 140 and the base 110 can be mutually buckled through the sprocket 141 and the bulge 111. The close bonding can avoid the shaking of the button 150 and further prevent slanting and jamming of the button 150.

The upper cover 140 and the base 110 are buckled to form the first containing chamber and the second containing chamber, the button 150 is located in the second containing chamber, the first balancing lever 171*a* and the second balancing lever 172*a* are also located in the second containing chamber. The contact area between the button 150 and the base 110 is small, the first balancing lever 171*a* and the second balancing lever 172*a* cooperate to ensure that the button 150 will not have slanting, there will be smaller friction force and labor-saving operation in case of upward and downward moving of the button 150.

The middle of the button 150 is provided with one positioning part, and the base 110 is provided with one positioning hole correspondingly. The positioning part is embedded in the positioning hole to position the button 150 from both sides, so as to further prevent the slanting and jamming of the button 150 during upward and downward movement and ensure the convenient use.

The button 150 is provided with the guide hole 151; correspondingly, the base 110 is provided with the guide column 112, the guide hole 151 is located out of the guide column 112 and moves upwards and downwards along the guide column 112. The guide hole 151 is located out of the guide column 112 to position the button 150 from the center, so as to ensure axial movement of the button 150, further prevent slanting or jamming of the button 150 during upward and downward movement, and ensure the convenient use.

The working principle of the keyboard switch is as follows:

During the downward movement of the button 150 after stress, it is positioned through two connecting racks; by this way, the button 150 will not easily have slanting or jamming during pressing, and the switch will have labor-saving operation, convenient use and good sense of touch during pressing. In addition, as the guide hole 151 is located out of the guide column 112, the button 150 can be positioned from the center; as the positioning part is embedded in the positioning hole, the button 150 can be positioned from both sides; by this way, it can ensure the axial movement of the button 150, further prevent slanting or jamming of the button 150 during upward and downward movement, and ensure the convenient use.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A keyboard switch, comprising:
a base;
a static contact;
a moving contact;
an upper cover;
a button, configured to control the contact of the static contact and the moving contact;
a reset spring, configured to control the reset of the button;
an X-shaped rack structure; and
a holding part, being disposed on the base to hold the X-shaped rack structure;
wherein
the upper cover is buckled on the base, and both the static contact and the moving contact are disposed on the base; one end of the button is installed on the base and is capable of moving upwards and downwards, another end thereof passes through the upper cover, and both ends of the reset spring abut against the button and the base, respectively;
the X-shaped rack structure comprises a first connecting rack and a second connecting rack which are rotatably embedded in the holding part;
the first connecting rack comprises a first balancing lever and two first connecting parts sleeving on the first balancing lever, the second connecting rack comprises a second balancing lever and two second connecting parts sleeving on the second balancing lever;
opposite surfaces of the two first connecting parts each are provided with one boss, facing surfaces of the two second connecting parts each are provided with one round hole, and the boss is inserted in the round hole so that two ends of the two first connecting racks and two ends of the two second connecting racks are connected to form two X-shaped structures; and
the holding part comprises a first rotating slot at two opposite sides of the base and a second rotating slot at another two opposite sides of the base.

2. The keyboard switch of claim 1, wherein
the first balancing lever comprises a first lever body and two first extension arms; the two first extension arms are integratedly extended from two ends of the first lever body, respectively; two ends of two first extension arms are bent to form two first connecting arms, the two first connecting arms are mutually reverse, and the two first connecting parts are respectively sleeved on the two first connecting arms;

the second balancing lever comprises a second lever body and two second extension arms, the two second extension arms are integratedly extended from two ends of the second lever body, respectively; two ends of two second extension arms are bent to form the second connecting arm, the two second connecting arms are mutually reverse, and two second connecting parts are respectively disposed on the two second connecting arms; and a bending part is disposed in a middle of the second lever body; the first lever body is embedded in the first rotating slot rotatably, and the two first connecting arms are embedded in the second rotating slot rotatably; the second lever body is embedded in the first rotating slot rotatably, and the two second connecting arms are embedded in the second rotating slot.

3. The keyboard switch of claim 2, wherein the first connecting part is located in the button, and the second connecting part is located out of the button.

4. The keyboard switch of claim 2, wherein the first connecting part is located in the button, and the second connecting part is located in the button.

5. The keyboard switch of claim 2, wherein the first connecting part is located out of the button, and the second connecting part is located out of the button.

6. The keyboard switch of claim 2, wherein the first connecting part is located out of the button, and the second connecting part is located in the button.

7. The keyboard switch of claim 1, wherein the upper cover and the base are buckled to form a first containing chamber and a second containing chamber; the static contact and the moving contact are located in the first containing chamber, the button and the reset spring are located in the second containing chamber; the first balancing lever and the second balancing lever are located in the second containing chamber.

* * * * *